United States Patent [19]

Goffinet et al.

[11] 4,126,562

[45] Nov. 21, 1978

[54] TEXTILE TREATMENT COMPOSITIONS

[75] Inventors: Pierre C. E. Goffinet; Jean-Pierre C. I. M. Leclercq, both of Brussels, Belgium

[73] Assignee: The Procter & Gamble Company, Cincinnati, Ohio

[21] Appl. No.: 801,685

[22] Filed: May 31, 1977

[30] Foreign Application Priority Data

Jun. 4, 1976 [LU] Luxembourg ..... 75088

[51] Int. Cl.[2] ..... D06M 13/38

[52] U.S. Cl. ..... 252/8.8; 8/115.6; 252/8.75; 252/8.6; 260/567.6 P

[58] Field of Search ..... 252/8.8, 8.75, 8.6; 8/115.6; 260/567.6 P

[56] References Cited

U.S. PATENT DOCUMENTS

| | | | |
|---|---|---|---|
| 3,154,489 | 10/1964 | DuBrow et al. | 252/8.8 |
| 3,334,138 | 8/1967 | Feeman | 260/567.6 P |
| 4,022,938 | 5/1977 | Zaki et al. | 252/8.6 |
| 4,045,361 | 8/1977 | Watt et al. | 252/8.8 |
| 4,049,557 | 9/1977 | Wixon | 252/8.8 |

*Primary Examiner*—William E. Schulz

[57] ABSTRACT

A textile treatment composition comprises certain polyamine salts and nonionic fabric conditioning substances which are fatty acid esters of alcohols or anhydrides having up to 8 carbon atoms. Particularly useful polyamine salts have a higher alkyl substituent and have ethoxylate or polyethoxylate substituents on the nitrogen atoms. Glycerol stearates and sorbitan stearates are preferred nonionic agents. The highly charged cationic species provide an excellent carrier system to encourage deposition of the nonionic fabric conditioner on fabrics which are rinsed in dilute aqueous solutions of the composition.

5 Claims, No Drawings

TEXTILE TREATMENT COMPOSITIONS

The invention relates to textile treatment compositions and, in particular, to textile treatment compositions which impart softness to fabrics.

It has long been recognized that certain chemical compounds have the capability of imparting softness to textile fabrics. These compounds, which are known generally as "softening agents", "fabric softeners", or "softeners", have been used both by the textile industry and by housewives in the laundry to soften a finished fabric, thereby making the fabric smooth, pliable and fluffy to handle. In addition to the quality of softness, the fabrics frequently have a reduced tendency to static cling and are easier to iron.

The softening agents which are usually employed in compositions intended for use by the housewife are cationic surfactant compounds, commonly quaternary ammonium compounds having at least two long alkyl chains, for example distearyl dimethyl ammonium chloride. The positive charge on the softening compound encourages its deposition onto the fabric substrate, the surface of which is usually negatively charged.

However, although the above mentioned cationic compounds are highly effective softeners when applied in a rinse solution, there are certain disadvantages associated with their use. In particular, the cationic compounds having long alkyl chains are very sensitive to carry over of anionic detergent into the rinse. Thus, carry over of anionic detergent tends to neutralize the softening effect because the anionic-cationic complex tends to precipitate out of solution. Also, certain cationic surfactant compounds are expensive and in short supply and it is therefore desirable, for commercial reasons, to provide softening compositions having a reduced amount of cationic surfactant compound. Furthermore, softening compositions which comprise predominantly long chain cationic compounds, especially di-long chain cationics, have the disadvantage that the treated fabrics tend to become overloaded with softener and become discoloured, greasy or undesirably non-absorbent.

While certain nonionic compounds have been proposed as fabric softening agents, it has been found that these deposit only very inefficiently from aqueous solution because of their lack of positive charge, and in order to obtain effective utilization of such compounds it is necessary to use them in conjunction with an automatic clothes dryer. The relatively high temperature of the drying process assists the nonionic softener compound to spread over the fabric surface as a melt. It has not heretofore been possible to utilize such compounds effectively in a rinse-added softener composition.

It is an object of the present invention to provide aqueous softening compositions which employ nonionic softeners and which provide excellent deposition onto the fabric surface from aqueous solution.

It is a further object of the invention to provide softening compositions which utilize cationic materials that are unusually insensitive to the presence of anionic surfactants.

The co-pending application U.S. patent application Ser. No. 595,632, filed on July 14, 1975, in the names of B. D. Barford and L. Benjamin, relates to a softening composition in the form of an aqueous dispersion in which the disperse phase comprises at least about 30% by weight of a fatty acid partial ester of a polyhydric alcohol or anhydride thereof containing from 3 to about 8 carbon atoms, and at least about 5% by weight of a cationic surfactant selcted from non-cyclic quaternary ammonium salts having at least one $C_{12}$–$C_{30}$ alkyl chain, $C_8$–$C_{25}$ alkyl imidazolinium salts, and $C_{12}$–$C_{20}$ alkyl pyridinium salts.

The quaternary ammonium salts having at least one $C_{12}$–$C_{30}$ alkyl chain can be monoquaternary ammonium compounds, i.e., compounds having a single positively charged N atom in their molecule, of formula

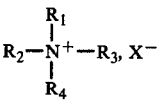

wherein group $R_1$ is $C_{12}$–$C_{22}$, preferably $C_{16}$–$C_{18}$ fatty alkyl and groups $R_2$, $R_3$ and $R_4$ are each $C_1$–$C_4$ alkyl, preferably methyl, and the counterion X is chloride, bromide, methyl sulphate etc. or they may be diquaternary ammonium salts of the above general formula wherein group $R_1$ is $C_{12}$–$C_{22}$ fatty alkyl, preferably $C_{16}$–$C_{18}$ alkyl, groups $R_2$ and $R_3$ are each $C_1$–$C_4$ alkyl, preferably methyl, and $R_4$ is the group $R_{10}R_{11}R_{12}R_{13}N^+$, $X^-$ wherein $R_{10}$ is $C_2$–$C_8$, preferably $C_3$–$C_4$, alkylene; $R_{11}$, $R_{12}$ and $R_{13}$ are each $C_1$–$C_4$ alkyl, preferably methyl-; and X is an anion, for example halide. These are derivatives of a quaternary ω-alkanediamine in which all the hydrogen atoms are replaced by a long chain alkyl or by short chain alkyls.

The essence of the present invention lies in the discovery that polyamine salts having preferably a single long chain alkyl group and optionally having the nitrogen atoms substituted by ethoxylate or propoxylate groups provide very effective carriers for the nonionic fabric softener and possess outstanding resistance to carry-over of anionic surfactant into the rinse solution.

SUMMARY OF THE INVENTION

According to the present invention, there is provided a textile softening composition in the form of an aqueous dispersion and comprising:

(a) a cationic material selected from (i) substituted polyamine salts having the formula (I)

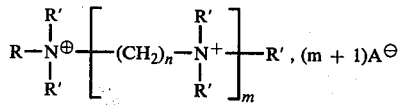

wherein R, and optionally one of the R′ groups fixed on the same nitrogen atom as R, is an alkyl or alkenyl group having from 10 to 22 carbon atoms; the other R′ groups are independently selected from hydrogen, $(C_2H_4O)_pH$, $(C_3H_6O)_pH$ and $C_1$–$C_4$ alkyl provided that not all R′ groups are $C_1$–$C_4$ alkyl; *p* is a number totalling not more than 25 per molecule; *m* is from 1 to 8; *n* is from 2 to 6; and $A^{\ominus}$ is an anion; and (ii) polyamine salts of the formula (I) wherein both R and R′ are selected from hydrogen and $C_1$–$C_4$ alkyl; *n* is from 2 to 6 and *m* is from 3 to 40, and (b) a nonionic fabric conditioning substance selected from fatty acid esters of mono- or polyhydric alcohols having from 1 to 8 carbon atoms and anhydrides thereof.

In this specification, the terms "alkyl" and "alkenyl" are intended to include substituted alkyl and alkenyl groups, for example with hydroxy-substituents, and also to include alkyl and alkenyl groups interrupted by bivalent functional groups, for example ether linkages.

DETAILED DESCRIPTION OF THE INVENTION

The Cationic Material

One group of preferred cationic materials have the general formula

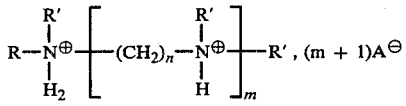

wherein R is $C_{10}$–$C_{22}$ alkyl, especially $C_{16}$–$C_{18}$ alkyl; R′ is hydrogen or $C_1$–$_4$ alkyl; *m* is from 1 to 3; *n* is from 2 to 6; and A is an anion such as chloride, acetate or methylsulphate. In preferred materials of this class, R′ is hydrogen, *m* is 1 and *n* is 3. An example is the dihydrochloride of N-tallowylpropylenediamine. The diacetate salt of this compound is sold by Pierrefitte-Auby under the Trade Name DINORAMAC and by Armour-Hess under the Trade Name DUOMAC. The term "tallowyl" denotes the predominantly $C_{16}$–$C_{18}$ alkyl groups derived from tallow fatty acids.

Another, and highly preferred group of cationic amine salts is that of the general formula (I) in which at least one of the nitrogen atoms is substituted with ethoxylate or propoxylate groups. Preferably, both nitrogen atoms are so substituted and most preferably with ethoxylate groups. The total number of ethoxylate groups in the molecule may go as high as 25 although normally not more than 15, preferably up to 6, ethoxylate groups are present.

The preferred alkoxylated species have the general formula (II)

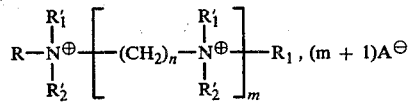

wherein R is a $C_{10}$–$C_{22}$ alkyl group; $R_1$ is $(C_2H_4O)_pH$ or $(C_3H_6O)_pH$ where the total *p* in the molecule is not more than 15; $R_2$ is hydrogen or $C_1$–$C_4$ alkyl; *n* is from 2 to 6; *m* is from 1 to 3 and A is an anion.

Specific ethoxylated materials suitable for use herein include:

N-tallowyl,N,N$^1$,N$^1$-tris(2-hydroxyethyl)1,3-propanediamine di-hydrochloride;

N-stearyl-N,N$^1$-di(2-hydroxyethyl)-N$^1$-(3-hydroxypropyl)-1,3-propanediamine dihydrofluoride;

N-oleyl N,N$^1$,N$^1$-tris(3-hydroxypropyl)-1,3-propanediamine dihydrofluoride;

N-stearyl N,N$^1$,N$^1$-tris (2-hydroxyethyl)N,N$^1$-dimethyl-1,3-propanediammonium dimethylsufphate;

N-palmityl N,N$^1$, N$^1$-tris(3-hydroxypropyl)-1,3-propanediamine dihydrobromide.

Another class of suitable fabric substantive cationic agents herein include polyalkylene imine salts, if desired substituted, having the formula:

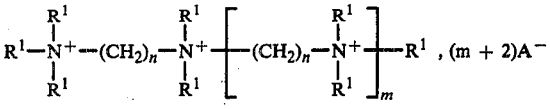

wherein $R^1$ is selected from hydrogen and $C_1$–$C_4$ alkyl, *n* is an integer from 2 to 6, *m* is an integer from 2 to about 40 and $A^-$ is as hereinbefore defined.

A preferred compound of this class is a polyethyleniminium chloride containing about 10 ethyleniminium units.

The unprotonated amines may also be used to prepare the compositions but it is highly preferred for a good product performance that their pH be such that at least one of the amine group of the polyamine is present in them or at least in the treatment bath in protonated form.

The cationic material is preferably used in an amount of from 0.5% to 10% by weight of the composition, more preferably from 1% to 5%.

The Nonionic Fabric Conditioning Agent

The essential nonionic softening agent of the present invention is a fatty acid ester, preferably a partial ester, of a mono- or polyhydric alcohol or anhydride thereof having from 1 to about 8 carbon atoms.

It is preferred that the fatty acid ester has at least 1 free (i.e. unesterified) hydroxyl group and at least 1 fatty acyly group.

The mono- or polyhydric alcohol portion of the ester can be represented by methanol, isobutanol, 2-ethyl hexanol, isopropanol, ethylene glycol and polyethylene glycol with a maximum of 5 ethylene glycol units, glycerol, diglycerol, xylitol, sucrose, erythritol, penta-erythritol, sorbitol or sorbitan. Ethylene glycol, glycerol and sorbitan esters are particularly preferred.

The fatty acid portion of the ester normally comprises a fatty acid having from 12 to 22 carbon atoms, typical examples being lauric acid, myristic acid, palmitic acid, stearic acid and behenic acid.

One highly preferred group of softening agents for use in the present invention is the sorbitan esters, which are esterified dyhydration products of sorbitol.

Sorbitol, itself prepared by the catalytic hydrogenation of glucose, can be dehydrated in well known fashion to form mixtures of 1,4- and 1,5-sorbitol anhydrides and small amounts of isosorbides. (See Brown, U.S. Pat. No. 2,322,821, issued June 29, 1943).

The foregoing type of complex mixtures of anhydrides of sorbitol are collectively referred to herein as "sorbitan". It will be recognised that this "sorbitan" mixture will also contain some free, uncyclized sorbitol.

The softening agents of the type employed herein can be prepared by esterifying the "sorbitan" mixture with a fatty acyl group in standard fashion, e.g. by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers: Processing and Quality Control:", *Journal of the American Oil Chemists' Society*, Volume 45, October 1968.

The mixtures of hydroxy-substituted sorbitan esters useful herein contain, inter alia, compounds of the following formulae, as well as the corresponding hydroxy-substituted di-esters:

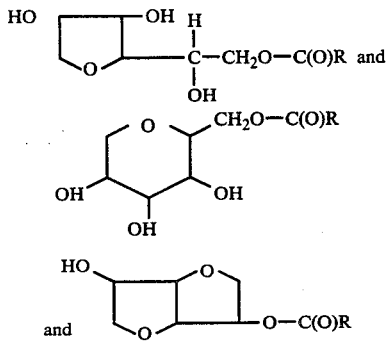

wherein the group R is a $C_{10}$-$C_{26}$, and higher, fatty alkyl residue. Preferably this fatty alkyl residue contains from 16 to 22 carbon atoms. The fatty alkyl residue can, of course, contain non-interfering substituents such as hydroxyl groups. Esterified hydroxyl groups can, of course, be either in terminal or internal positions within the sorbitan molecule.

The foregoing complex mixtures of esterified dehydration products of sorbitol (and small amounts of esterified sorbitol) are collectively referred to herein as "sorbitan esters". Sorbitan mono- and di-esters of lauric, myristic, palmitic, stearic and behenic (docosanoic) acids are particularly useful herein as softening agents and also can provide an anti-static benefit to fabrics. Mixed sorbitan esters, e.g. mixtures of the foregoing esters, and mixtures prepared by esterifying sorbitan with fatty acid mixtures such as the mixed tallow fatty acids, are useful herein and are economically attractive. Unsaturated $C_{10}$-$C_{22}$ sorbitan esters, e.g. sorbitan monooleate, usually are present in such mixtures in low concentration. The term "alkyl" as employed herein to describe the sorbitan esters encompasses both the saturated and unsaturated hydrocarbyl ester side chain groups.

Certain derivatives of the sorbitan esters herein, especially the "lower" ethoxylates thereof (i.e. mono-, di- and tri-esters) wherein one or more of the unesterified —OH groups contain one to about 20 oxyethylene moieties (Tweens$^R$) are also useful in the composition of the present invention. Therefore, for purposes of the present invention, the term "sorbitan ester" includes such derivatives.

Preparation of the sorbitan esters can be achieved by dehydrating sorbitol to form a mixture of anhydrides of the type set forth above, and subsequently esterifying the mixture using, for example, a 1:1 stoichiometry for the esterification reaction. The esterified mixture can then be separated into the various ester components. Separation of the individual ester products is, however, difficult and expensive. Accordingly, it is easier and more economical not to separate the various esters, using instead the esterified mixture as the sorbitan ester component. Such mixtures of esterified reaction products are commercially available under various tradenames e.g. Span$^R$ Such sorbitan ester mixtures can also be prepared by utilizing conventional interesterification procedures.

For the purposes of the present invention, it is preferred that a significant amount of di- and tri-sorbitan esters are present in the ester mixture. Ester mixtures having from 20%-50% mono-ester, 25% to 50% di-ester and 10%-35% of tri- and tetra-esters are preferred.

The material which is sold commercially as sorbitan mono-ester (e.g. mono-stearate) does in fact contain significant amounts of di- and tri-esters and a typical analysis of sorbitan monostearate indicates that it comprises ca.27% mono-, 32% di- and 30% tri- and tetra esters. Commercial sorbitan mono-stearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5- sorbitan esters are useful herein.

Other useful alkyl sorbitan esters for use in the softening compositions herein include sorbitan monolaurate, sorbitan monomyristate, sorbitan monopolmitate, sorbitan mono-behenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction, It is to be recognised, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

It is also to be recognised that the sorbitan esters employed herein can contain up to about 15% by weight of esters of the $C_{20}$-$C_{26}$, and higher, fatty acids, as well as minor amounts of $C_8$, and lower, fatty esters. The presence or absence of such contaminants is of no consequence in the present invention.

Other fatty acid partial esters useful in the present invention are xylitol monopalmitate, pentaerythritol monostearate, sucrose monostearate, glycerol monostearate and ethylene glycol monostearate. As with the sorbitan esters, commercially available mono-esters normally contain substantial quantities of di- or tri-esters.

The glycol esters are also highly preferred. These are the mono-, di- or tri-esters of glycerol and fatty acids of the class described above. Commercial glyceryl monostearate, which may contain a proportion of the di- and tristearates, is especially preferred.

The above-discussed nonionic compounds are correctly termed "softening agents", because, when the compounds are correctly applied to a fabric, they do impart a soft, lubricious feel to the fabric. However, it has not heretofore been found possible to apply such compounds from dilute, aqueous rinse solution to fabrics in such a way that adequate deposition is obtained. The present invention provides a means whereby good deposition of the above compounds can be achieved through their combination with certain cationic surfactants which are discussed in greater detail above.

The relative proportions of cationic surfactant and ester in the compositions is preferably in the range from about 12:1 to 1:4 by weight, and especially from 4:1 to 2:3.

The nonionic agent is conveniently used in an amount from 0.5% to 10% preferably from 2% to 6% by weight of the composition.

The compositions of this invention can optionally contain up to 6% by weight of a cationic compatabilizing agent selected from the group consiting of a water-insoluble Di-$C_{10}$–$C_{22}$ alkyl quaternary ammonium salt, a $C_8$–$C_{25}$ alkylimidazolinium salt and mixtures thereof.

Well-known species of substantially water-insoluble quaternary ammonium compounds have the formula

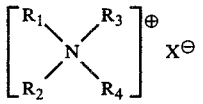

wherein $R_1$ and $R_2$ represent hydrocarbyl groups of from about 10 to about 22 carbon atoms; $R_3$ and $R_4$ represent hydrocarbyl groups containing from 1 to about 4 carbon atoms; X is an anion and *n* is an integer from 1 to 3, preferably selected from halide, and methyl sulfate radicals. Representative examples of quaternary softeners include ditallow dimethyl ammonium chloride; ditallow dimethyl ammonium methyl sulfate; dihexadecyl dimethyl ammonium chloride; di(hydrogenated tallow) dimethyl ammonium chloride: dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconutalkyl) dimethyl ammonium chloride. Ditallow dimethyl ammonium chloride, di(hydrogenated tallow-alkyl) dimethyl ammonium chloride and di(coconut-alkyl) dimethyl ammonium chloride are preferred.

Another class of suitable cationic compatibilizing agents can be represented by $C_{8-25}$ alkylimidazolinium salts. Preferred salts are those conforming to the formula

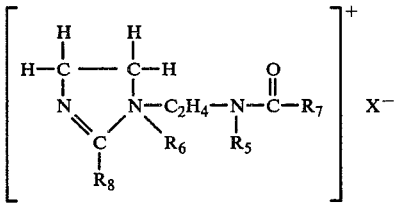

wherein $R_6$ is a $C_1$–$C_4$ alkyl radical, $R_5$ is hydrogen or a $C_1$–$C_4$ alkyl radical, $R_8$ is a $C_8$–$C_{25}$ alkyl radical and $R_7$ is hydrogen or a $C_8$–$C_{25}$ alkyl radical. X is a charge balancing ion which has the same meaning as X defined in the quaternary ammonium compatibilizing agent above.

The optional cationic compatibilizing is frequently used in an amount up to about 6%, preferably in an amount from 0.5% to 4%.

In preferred executions of this invention, the weight ratio of substituted polyamine and, if present, cationic compatibilizing agent to nonionic fabric lubricant is equal to or greater than 0,6, preferably $\geqq 0.9$.

In addition to the above described components the compositions may contain other textile treatment or conditioning agents. Such agents include silicones, as for example, described in German patent application No. DOS 26,31,419 incorporated herein by reference.

The optional silicone component can be used in an amount of from about 0,5% to about 6%, preferably from 1% to 4% of the softener composition. In other preferred executions of this invention the weight ratio of the sum of nonionic fabric lubricant and silicone to total cationic surfactant is in the range from 2:1 to 1:3.

The compositions herein can contain optional ingredients which are known to be suitable for use in textile softeners at usual levels for their known function. Such adjuvants include emulsifiers, perfumes, preservatives, germicides, viscosity modifiers, colorants, dyes, fungicides, stabilizers, brighteners, and opacifiers. These adjuvants, if used, are normally added at their conventional low levels (eg., from about 0.1% to 5% by weight).

The compositions can normally be prepared by mixing the ingredients together in water, heating to a temperature of about 60° C and agitating for 5–30 minutes.

It is highly preferred and generally provides better performance, first to mix the cationic in the molten nonionic fabric lubricant or mix both together in liquid form, and then disperse the mixture in the aqueous carrier medium with good agitation. Depending upon the particular selection of nonionic lubricant and cationic surfactant, it may be necessary in certain cases to include other emulsifying ingredients or to employ more efficient means for dispersing and emulsifying the particles (eg. high speed blender).

Normally, at 60° C, the softening agents exist in liquid form and therefore form true emulsions with an aqueous continuous phase. On cooling, the disperse phase may wholly or partially solidify so that the final composition exists as a dispersion which is not a true liquid/liquid emulsion. It will be understood that the term "dispersion" means liquid/liquid phase or solid/liquid phase dispersions and emulsions.

For normal use as rinse-added compositions, the disperse phase constitutes 1–30%, preferably 3–20%, more preferably 4–10% of the composition.

The following examples illustrate the invention.

EXAMPLE 1

Glycerine monostearate (50 g.) was heated to form a melt and tallowylpropanediamine dihydrochloride (70 g.) was mixed therein. The mixture was added to water at 60° C and agitated for 20 minutes. The mixture was made up to 1000 ml. with water to give a dispersion containing 7% of the diamine salt and 5% of glycerine monostearate (GMS). This product gave a significant softening benefit on fabrics rinsed in a dilute solution of the composition.

EXAMPLE 2

Glycerine monostearate (35 g.) was melted and to the melt was added DTDMAC (30 g.) and tallowylpropanediamine dihydrochloride (20 g.). The mixture was then dispersed by stirring into 1 liter of water to give an effective fabric softening composition in emulsion form.

EXAMPLE 3

Following the procedure of Example 2, a composition was prepared having 3% of DTDMAC, 3.5% of GMS and 2% of N-stearyl-N,N$^1$,N$^1$-tri(2-hydroxyethyl)-1,3-propane diamine dihydrochloride.

The above composition also gave an excellent softening benefit on fabrics rinsed in a dilute solution of the compositions.

The following are further examples of the invention:

| Example No.: Ingredients | 4 % | 5 % | 6 % | 7 % | 8 % | 9 % | 10 % | 11 % |
|---|---|---|---|---|---|---|---|---|
| DTDMAC | 2.5 | — | 2 | 1 | 4 | 3 | 2 | 1 |
| GMS | 3 | 3.5 | 3.5 | 3 | 2 | 4 | 2.5 | 3 |
| N-stearylpropylene diamine dihydrochloride | — | — | 4 | 1.5 | — | — | — | — |
| N-tallowyl N,N',N'-tris(2-hydroxyethyl) 1,3-propanediamine dihydrochloride | 2 | 4 | — | — | 2 | — | — | — |
| N-stearyl N,N',N'-tris(2-hydroxyethyl) N,N'-dimethyl-1,3-propanediamonnium dimethylsulphate | — | — | — | — | — | 1.5 | — | 1.5 |
| N-palmityl N',N',N'-tris(3-hydroxypropyl)-1,3-propanediamine dihydrobromide | — | — | — | 1.5 | — | — | 2 | 1.5 |

What is claimed is:

1. A textile-treating composition in the form of an aqueous dispersion and comprising (i) a cationic surfactant of the general formula

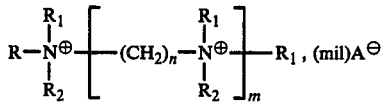

wherein R is a $C_{10}$–$C_{22}$ alkyl group; $R_1$ is $(C_2H_4O)_pH$ or $(C_3H_6O)_pH$ where the total $p$ in the molecule is not more than 15; $R_2$ is hydrogen or $C_1$–$C_4$ alkyl; $n$ is from 2 to 6; $m$ is from 1 to 3 and A is an anion, and (ii) a nonionic fabric-conditioning substance selected from fatty acid esters of mono- or polyhydric alcohols having from 1 to 8 carbon atoms and anhydrides thereof, wherein the ratio fo said cationic surfactant to said nonionic fabric-conditioning substance is from 4:1 to 2:3.

2. A composition according to claim 1 wherein $R_2$ is hydrogen; $m$ is 1; $n$ is 3 and the total $p$ in the molecule is from 3 to 6.

3. A composition according to claim 1 wherein the nonionic fabric conditioning substance is selected from the group consisting of glycerol monostearate, sorbitan monostearate, ethyleneglycol monostearate, diglycerol-monotallowate, xylitol monopalmitate, and a 1:2 molar mixture of glyceroltristearate and glycerolmonostearate 4. A composition according to claim 1 comprising from 0.5% to 10% of said cationic surfactant and from 0.5% to 10% of said nonionic substance in an aqueous medium.

5. A composition according to claim 4 additionally comprising up to 6% of an insoluble cationic softener selected from di-$C_{10}$–$C_{22}$ alkyl quaternary ammonium salts and $C_8$–$C_{25}$ imidazolinium salts.

* * * * *

UNITED STATES PATENT AND TRADEMARK OFFICE

CERTIFICATE OF CORRECTION

PATENT NO. : 4,126,562

DATED : November 21, 1978

INVENTOR(S) : Pierre C.E. Goffinet and Jean Pierre C.I.M. Leclercq

It is certified that error appears in the above-identified patent and that said Letters Patent are hereby corrected as shown below:

Column 3, lines 42 - 48, the formula should be

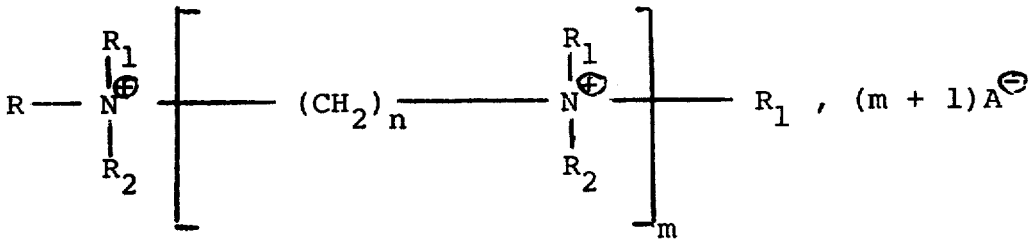

Column 4, line 45, "dyhydration" should be --dehydration--.

Column 6, line 22, "monopolmitate" should be --monopalmitate--.

Column 10, line 4, "mil" should be --m+1--.

Column 10, line 15, "fo" should be --of--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*